US006763213B2

(12) United States Patent
Ahn

(10) Patent No.: US 6,763,213 B2
(45) Date of Patent: Jul. 13, 2004

(54) APPARATUS FOR FORMING COLOR IMAGE USING ELECTROPHOTOGRAPHY

(75) Inventor: Hyung-jin Ahn, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/270,716

(22) Filed: Oct. 16, 2002

(65) Prior Publication Data

US 2003/0147672 A1 Aug. 7, 2003

(30) Foreign Application Priority Data

Feb. 6, 2002 (KR) ..... 2002-6752

(51) Int. Cl.[7] ..... G03G 15/01
(52) U.S. Cl. ..... 399/228
(58) Field of Search ..... 399/228, 223, 399/112, 298, 234; 347/140, 115, 117

(56) References Cited

U.S. PATENT DOCUMENTS 4,710,016 A * 12/1987 Waatanabe ..... 399/228
4,939,547 A * 7/1990 Miyaji et al. ..... 399/228
5,298,948 A * 3/1994 Kurisu ..... 399/119
5,412,457 A * 5/1995 Kawano et al. ..... 399/228
6,081,683 A * 6/2000 Miyasaka et al. ..... 399/228
6,600,889 B2 * 7/2003 Hiroki et al. ..... 399/228
2003/0138269 A1 * 7/2003 Hiroki ..... 399/228

FOREIGN PATENT DOCUMENTS

JP 63-097968 * 4/1988
JP 11-327297 * 11/1999
KR 4-274454 9/1992

* cited by examiner

*Primary Examiner*—Sophia S. Chen
(74) *Attorney, Agent, or Firm*—Staas & Halsey LLP

(57) ABSTRACT

An apparatus for forming a color image using electrophotography includes a photosensitive drum on which a predetermined electrostatic latent image is formed, a plurality of developing units including a developing roller supplying toner to a surface of the photosensitive drum to develop the electrostatic latent image, and pressure cams sequentially or selectively pressing corresponding ones of the developing units toward the photosensitive drum when the electrostatic latent image is developed. A bracket slide disposed in the apparatus uses tension springs to generate the same normal force in a predetermined range regardless of relative positions of the developing units, and the same normal force are applied to the photosensitive drum from the respective developing rollers while reducing a shock occurring when the developing roller contacts the photosensitive drum.

25 Claims, 5 Drawing Sheets

APPARATUS FOR FORMING COLOR IMAGE USING ELECTROPHOTOGRAPHY

CROSS-REFERENCE TO RELATED APPLICATIONS

This application claims the benefit of Korean Patent Application No. 2002-6752, filed Feb. 6, 2002, in the Korean Industrial Property Office, the disclosure of which is incorporated herein by reference.

BACKGROUND OF THE INVENTION

1. Field of the Invention

The present invention relates to an apparatus for forming a color image, and more particularly, to an apparatus for forming a color image using electrophotograpy, reducing a shock occurring when a developing roller contacts a photosensitive drum, and having a developing unit capable of reducing a pressure difference between the developing roller and the photosensitive drum.

2. Description of the Related Art

In an apparatus for forming a color image using electrophotography, such as a digital copying machine, a color laser printer or the like, a predetermined electrostatic latent image is formed on a photosensitive body. Then, the electrostatic latent image is developed with toner, and the developed image is transferred onto paper via a predetermined transfer medium. Thereafter, the transferred image is heated and pressed, thereby being permanently fused on the paper.

Referring to FIG. 1, the apparatus for forming the color image using electrophotography includes a photosensitive drum 10 as a photosensitive body, a charger 11 charging the photosensitive drum 10, a laser scanning unit (LSU) 12 radiating light onto the charged photosensitive drum 10 and forming a predetermined electrostatic latent image, developing units 13 developing the electrostatic latent image with the toner having four colors, such as yellow (Y), magenta (M), cyan (C), and black (K), a transfer belt 14 on which each developed image having one of the four colors is sequentially overlapped, a first transfer roller 14*a* transferring the developed image from the photosensitive drum 10 onto the transfer belt 14, a second transfer roller 14*b* transferring the transfer image having four colors overlapped on the transfer belt 14 onto paper, and a fusing unit 15 heating and pressing the paper and permanently fusing the transferred image on the paper.

Four developing units 13-Y, 13-M, 13-C, and 13-K are elastically biased by corresponding springs (not shown) to be apart from the photosensitive drum 10 and selectively move toward the photosensitive drum 10 according to a rotation of cams 13*b*. A developing roller 13*a* is disposed on a front end of the developing units to contact the photosensitive drum 10. The apparatus includes a paper cassette 16, a blade 17 cleaning the photosensitive drum 10, an eraser 18, and a transfer path 19 in which paper is exhausted.

In the apparatus for forming the color image using electrophotography shown in FIG. 1, the color image is formed as follows. First, the photosensitive drum 10 is charged by the charger 11, light is radiated on the photosensitive drum 10 by the LSU 12, and then, an electrostatic latent image of the color image to be developed with a first color is formed in a predetermined region of the photosensitive drum 10. For example, if a yellow image having a yellow color is developed first, as shown in FIG. 2, a developing unit 13-Y having the yellow color accesses the photosensitive drum 10 by the rotation of a corresponding cam 13*b*-Y, and thus the electrostatic latent image formed on the photosensitive drum 10 is developed with a yellow toner.

FIG. 3 is an enlarged view of the photosensitive drum 10 and a developing roller 13*a*-Y of the developing unit 13-Y in a development operation. Referring to FIG. 3, when a predetermined force is applied to a leaf spring 13*c* placed at a rear side of the developing unit 13-Y by a rotation of the cams 13*b*, the leaf spring 13*c* is displaced by a predetermined distance ▼X, a force is transferred to the developing unit 13-Y, and thus the developing roller 13*a*-Y contacts the photosensitive drum 10. Toner T stained on an outer circumference of the developing roller 13*a*-Y is transferred by this contact to the electrostatic latent image of the photosensitive drum 10 contacting the developing roller 13*a*-Y In this case, in order to increase an amount of a toner per area stained on the photosensitive drum 10, the developing roller 13*a*-Y rotates at an angular velocity larger than that of the photosensitive drum 10. The developed yellow image is transferred onto the transfer belt 14 through a first transfer nib N1 as shown in FIG. 1.

Subsequently, another electrostatic latent image for a second color is formed by charging and exposing the photosensitive drum 10. If a second color is magenta, as shown in FIG. 4, a developing unit 13-M having a magenta color accesses the photosensitive drum 10, thereby forming the electrostatic latent image. The developed magenta image is overlapped with the developed yellow image and transferred on the transfer belt 14 on which the yellow image was transferred. In the same way, another image having a cyan color as a third color, and another image having a black color as a fourth color are developed and transferred, thereby forming the color image having a desired color on the transfer belt 14. After that, the color image is transferred onto the paper supplied to a second transfer nib N2 between the transfer belt 14 and the second transfer roller 14*b* and is heated and pressed through the fusing unit 15 and is permanently fused on the paper.

Likewise, since the electrostatic latent image formed on the photosensitive drum 10 is developed while the four developing units 13-Y, 13-M, 13-C, and 13-K sequentially or selectively contact and/or separate from the photosensitive drum 10, shock may be applied to the photosensitive drum 10 whenever the developing rollers 13*a* of the developing units 13-Y, 13-M, 13-C, and 13-K collide with the photosensitive drum 10. In this case, jitter of the developed image may occur at the time of collision of the developing units 13-Y, 13-M, 13-C, and 13-K and the photosensitive drum 10.

An angular velocity of the developing rollers 13*a* of the four developing units 13-Y, 13-M, 13-C, and 13-K is larger than that of the photosensitive drum 10. Due to this angular velocity difference, a shock applied to the photosensitive drum 10 increases when the developing roller 13*a* contacts the photosensitive drum 10 to develop the electrostatic latent image. In general, a photosensitive layer is coated on an aluminum material to form the photosensitive drum 10, and the developing roller 13*a* formed of a rubber material has a predetermined hardness. Thus, if a hardness of the rubber material is reduced, the shock due to the contact may be slightly reduced.

However, an angular velocity difference is set such that toner T is supplied from the developing roller 13*a* to the photosensitive drum 10. When the developing roller 13*a* contacts the photosensitive drum 10, the developing units 13-Y, 13-M, 13-C, and 13-K are instantaneously pushed against the photosensitive drum 10, registration defects where overlapped layers of developed images of the colors are dislocated, and the jitter occurs. As a result, a resolution of the color image deteriorates. In addition, due to the contact shock, the toner T is scattered in the apparatus, and thus peripheral devices of the apparatus may be contaminated. Problems caused by the angular velocity difference may occur whenever the developing roller 13*a* contacts the photosensitive drum 10 and is separated from the photosensitive drum 10. These problems can be slightly reduced by limiting the angular velocity of the developing roller 13*a*. However, if the angular velocity of the developing roller 13*a* is too small, the toner T is not sufficiently supplied to the photosensitive drum 10 to develop the latent electrostatic image, and thus a quality of the color image deteriorates.

As mentioned above, since the photosensitive drum 10 is a rigid body, and since the leaf spring 13*c* formed in the developing units 13-Y, 13-M, 13-C, and 13-K has a large spring elasticity coefficient, when the photosensitive drum 10 contacts the developing units 13-Y, 13-M, 13-C, and 13-K, a repulsive force is strongly generated. As a result, a pressure difference between the photosensitive drum 10 and each of the developing units 13-Y, 13-M, 13-C, and 13-K occurs, and thus it is difficult that the photosensitive drum 10 stably contacts the developing roller 13*a*. Even though the photosensitive drum 10 stably contacts the developing roller 13*a*, the shock caused when the photosensitive drum 10 contacts the developing roller 13*a* is transferred to the photosensitive drum 10, and thus the jitter and bending of the color image occur.

Accordingly, in order to form a clear and a high quality image, it is required to provide a method of removing the above causes of image defects while maintaining a proper amount of the toner T supplied to the photosensitive drum 10 in the development step operation.

SUMMARY OF THE INVENTION

To solve the above and other problems, it is an object of the present invention to provide an apparatus for forming a color image using electrophotography. The apparatus reduces a shock and a pressure difference between a photosensitive drum and each developing roller to form a high quality image.

Additional objects and advantageous of the invention will be set forth in part in the description which follows and, in part, will be obvious from the description, or may be learned by practice of the invention.

Accordingly, to achieve the above and other objects, there is provided an apparatus for forming a color image using electrophotography. The apparatus includes a photosensitive drum on which a predetermined electrostatic latent image is formed, a plurality of developing units each including a developing roller supplying toner to a surface of the photosensitive drum to develop the electrostatic latent image, and pressure cams sequentially or selectively pressing corresponding ones of the developing units against the photosensitive drum when the electrostatic latent image is developed.

A bracket slide includes tension springs generating the same normal force in a predetermined range regardless of relative positions of the developing units with respect to the photosensitive drum. The same normal force is applied to the photosensitive drum from the developing roller while reducing a shock occurring when the developing roller contacts the photosensitive drum.

According to an aspect of the present invention, the tension spring of each developing unit has the same material, but has a different thickness from that of another developing unit. On the contrary, if the tension spring of each developing unit has the same thickness as that of another developing unit, the tension spring of each developing unit has a different material from that of another developing unit.

In the apparatus for forming a color image using electrophotography, the shock caused when the photosensitive drum contacts the developing roller can be slightly absorbed, and thus jitter or bending can be removed or minimized in a development operation. In addition, the same normal force applied to the photosensitive drum from the developing rollers regardless of positions of the developing rollers can be maintained, and thus the deterioration of an image quality due to the pressure difference can be prevented. Further, since the shock between the photosensitive drum and the developing roller is reduced, the developing roller can smoothly contact and/or be separated from the photosensitive drum, and the scattering of the toner caused when the developing roller contacts and/or is separated from the photosensitive drum can be minimized.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
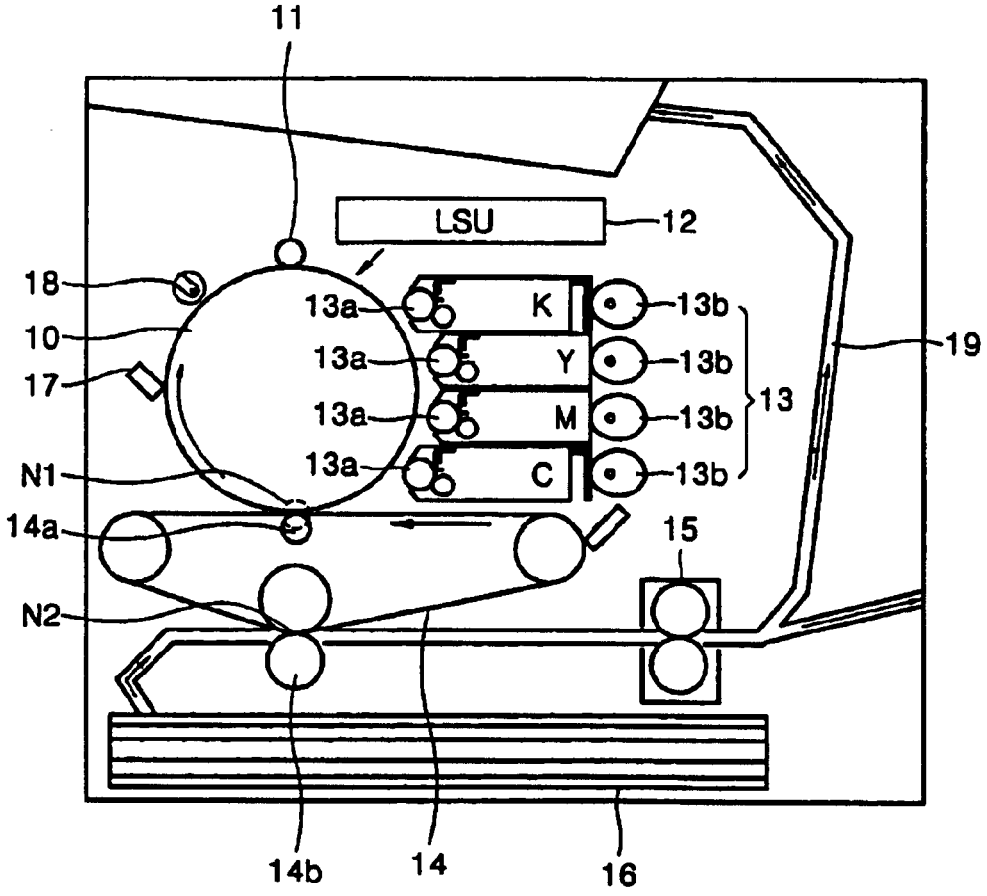
FIG. 1 (PRIOR ART)
FIG. 1 is a cross-sectional view illustrating a structure of a conventional apparatus for forming a color image using electrophotography.
Figure 2:
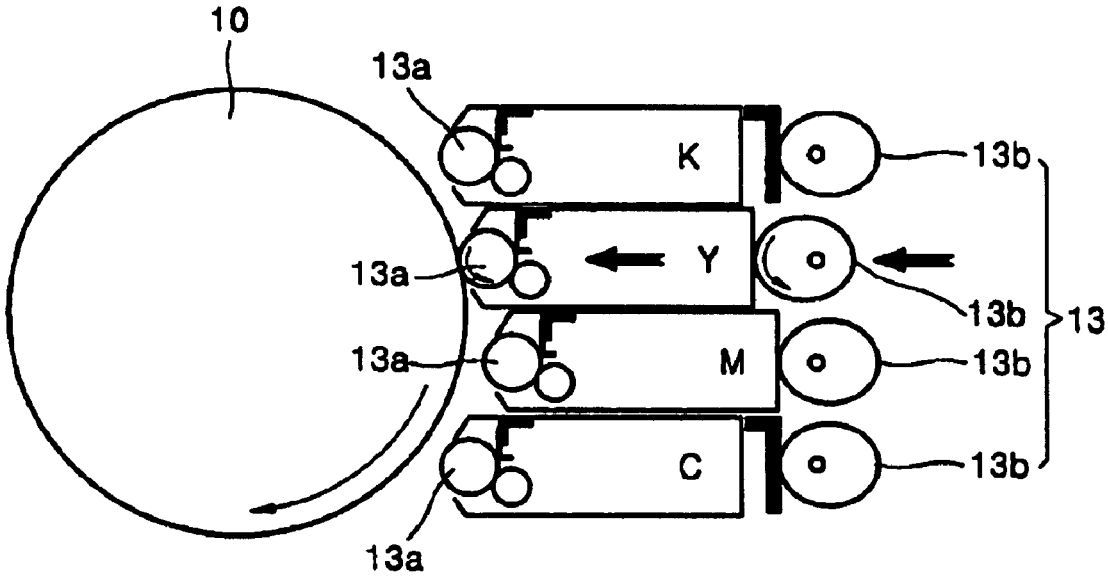
FIG. 2 (PRIOR ART)
FIGS. 2 through 4 illustrate contact and separation phases of a developing unit of the apparatus shown in FIG. 1.
Figure 3:
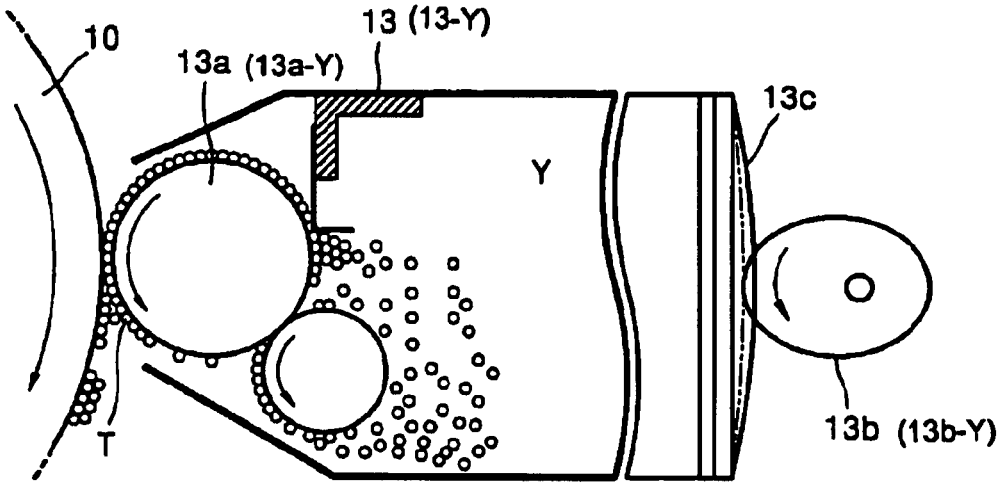
FIG. 3 (PRIOR ART)
Figure 4:
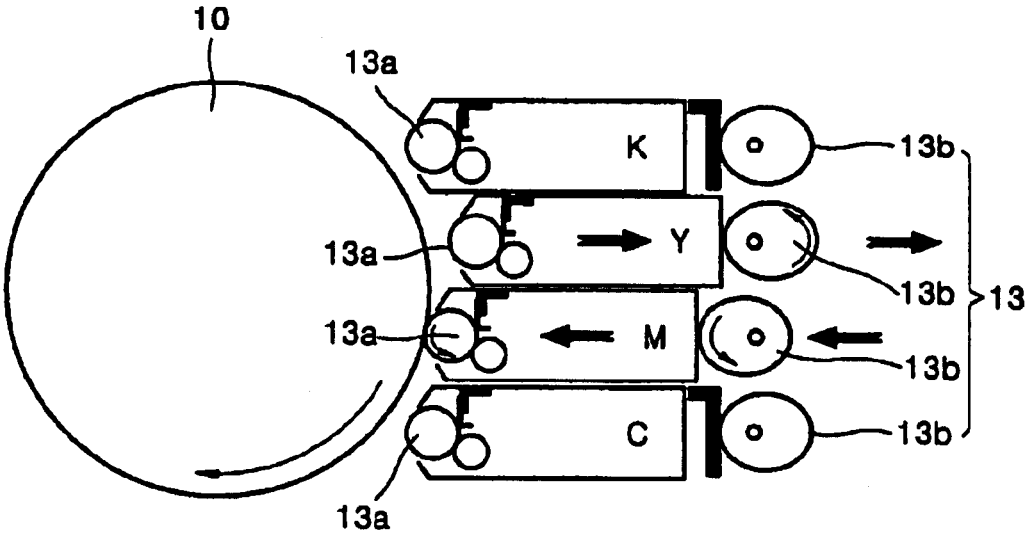
FIG. 4 (PRIOR ART)

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinafter, embodiments of the present invention will be described more fully hereinafter with reference to the accompanying drawings.

Figure 5:
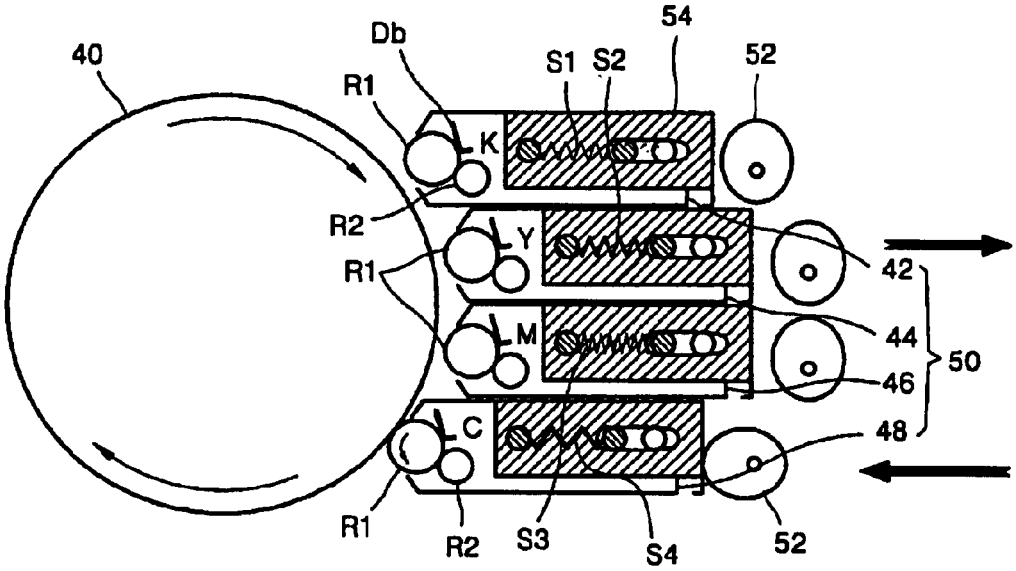
FIG. 5 is a partial cross-sectional view of an apparatus for forming a color image using electrophotography according to an embodiment of the present invention.

Referring to FIG. 5, an apparatus for forming a color image using electrophotography according to an embodiment of the present invention includes a photosensitive drum 40 charged by a charger (not shown) disposed adjacent to the apparatus and on which an electrostatic latent image corresponding to an image to be printed is formed, a developing unit 50 including first through fourth color developing units 42, 44, 46, and 48 developing the electrostatic latent image on the photosensitive drum 40, and pressure cams 52 each disposed at a rear end of corresponding ones of the first through fourth color developing units 42, 44, 46, and 48. The first through fourth color developing units 42, 44, 46, and 48 develop the electrostatic latent image using toner having four colors, such as black (K), yellow (Y), magenta (M), and cyan (C). The pressure cams 52 apply a predetermined force to the first through fourth color developing units 42, 44, 46, and 48, respectively, when the electrostatic latent image is developed. The pressure cams 52 selectively apply a predetermined force to one of the color developing units 42, 44, 46, and 48 such that developing rollers R1 of the first through fourth color developing units 42, 44, 46, and 48, sequentially contact the photosensitive drum 40 or that the developing roller R1 of the selected developing unit contacts the photosensitive drum 40.

Each of the first through fourth color developing units 42, 44, 46, and 48 includes the developing roller R1 supplying a color toner to the surface of the photosensitive drum 40 by contacting the photosensitive drum 40, a supply roller R2 supplying the color toner to the developing roller R1 from a color toner supplying source (not shown), a doctor blade Db uniformly coating the color toner supplied to the developing roller R1 on the surface of the developing roller R1, and tension springs S1, S2, S3, and S4 removing or reducing a shock and a pressure difference caused by a contact between the developing roller R1 and the photosensitive drum 40. The tension springs S1, S2, S3, and S4 are mounted in a bracket slide 54, so that the color developing units 42, 44, 46, and 48 apply a uniform pressure in a direction perpendicular to the surface of the photosensitive drum 40. For this purpose, the tension springs S1, S2, S3, and S4 may be mounted in corresponding different regions of the color developing units 42, 44, 46, and 48 with respect to the photosensitive drum 40 or between each of the color developing units 42, 44, 46, and 48 and the corresponding cams 52.

Figure 6:
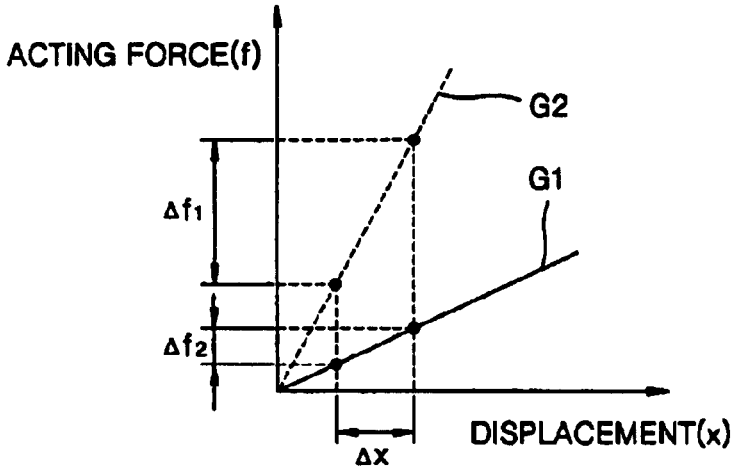
FIG. 6 is a graph illustrating variations of an acting force with respect to a displacements of a leaf spring and a tension spring, respectively, used in the apparatus of FIG. 5.

FIG. 6 is a graph illustrating acting force variations with respect to displacements of a leaf spring and a tension spring. A first full-line G1 represents a case of the tension spring, while a second full-line G2 represents the other case of the leaf spring.

As shown in FIG. 6, the acting force variation Δf1 of the leaf spring is much larger than the acting force variation Δf2 of the tension spring for the same displacement ΔX. This means that in the case of the tension spring, a portion of the shock force can be slightly absorbed, whereas in the case of the leaf spring, the shock force cannot be absorbed. Thus, by using the color developing unit having the tension spring rather than by using a conventional developing unit having the leaf spring, the shock and a repulsive force transferred to the photosensitive drum 40 can be reduced when the electrostatic latent image formed on the photosensitive drum 40 is developed.

Figure 7:
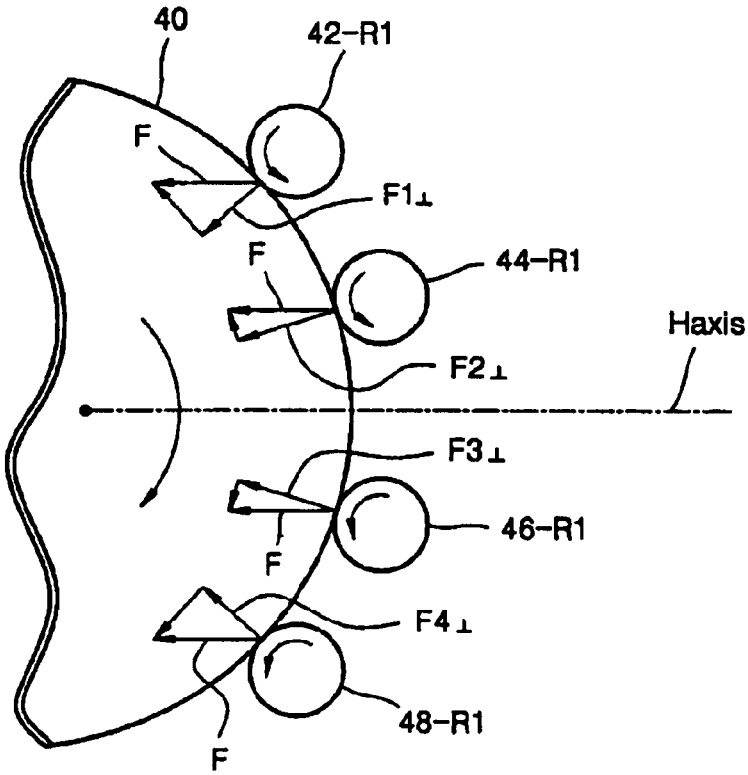
FIG. 7 is a cross-sectional view illustrating that a normal force applied to a photosensitive drum varies according to a position of a developing roller in the apparatus of FIG. 5.

Referring to FIG. 7, respective forces F applied to the photosensitive drum 40 from developing rollers 42-R1, 44-R1, 46-R1, and 48-R1 in a development operation are the same regardless of the positions of the developing rollers 42-R1, 44-R1, 46-R1, and 48-R1 with respect to the photosensitive drum 40. That is, even though the developing roller 42-R1 of the first developing unit 42 is at a larger distance from a horizontal axis H, through which a center of the photosensitive drum 40 passes, than the developing roller 44-R1 of the second developing unit 44, the forces F applied to the photosensitive drum 40 from the developing rollers 42-R1 and 44-R1 are the same. However, considering another force toward the center of the photosensitive drum 40 from a contact point of the photosensitive drum 40 and the developing roller R1 in a radial direction of the center of the photosensitive drum 40 (hereinafter, referred to as a normal force) and the force F in a direction parallel to the horizontal axis H of the photosensitive drum 40, the normal force applied to the photosensitive drum 40 varies according to the positions of the developing rollers 42-R1, 44-R2, 46-R1, and 48-R1, that is, according to the positions of the first through fourth color developing units 42, 44, 46, and 48.

Specifically, a first normal force F1⊥ is applied to the photosensitive drum 40 from the developing roller 42-R1 at the contact point of the developing roller 42-R1 of the first color developing unit 42 and the photosensitive drum 40, a second normal force F2⊥ is applied to the photosensitive drum 40 from the developing roller 44-R1 at the contact point of the developing roller 44-R1 of the second color developing unit 44 and the photosensitive drum 40, a third normal force F3⊥ is applied to the photosensitive drum 40 from the developing roller 46-R1 at the contact point of the developing roller 46-R1 of the third color developing unit 46 and the photosensitive drum 40, and a fourth normal force F4⊥ is applied to the photosensitive drum 40 from the developing roller 48-R1 at the contact point of the developing roller 48-R1 of the fourth color developing unit 48 and the photosensitive drum 40.

Respective lengths of arrows indicating the first through fourth normal forces F1⊥, F2⊥, F3⊥, and F4⊥ represent magnitudes of the normal forces and are not the same. This means that the first through fourth normal forces F1⊥, F2⊥, F3⊥, and F4⊥ are different form one another. In other words, the normal force applied to the photosensitive drum 40 from the developing rollers 42-R1, 44-R1, 46-R1, and 48-R1 varies according to the positions of the developing rollers 42-R1, 44-R1, 46-R1, and 48-R1, that is, according to corresponding angles which the photosensitive drum 40 contacts the developing rollers 42-R1, 44-R1, 46-R1, and 48-R1 to form with respect to the horizontal axis H. The angles are formed between the horizontal axis H and respective radial lines in a radial direction perpendicular to the surface of the photosensitive drum 40.

However, when the developing rollers 42-R1, 44-R1, 46-R1, and 48-R1 are disposed symmetrical from the horizontal axis H of the center of the photosensitive drum 40, the normal force applied to the photosensitive drum 40 from the corresponding developing roller 42-R1, 44-R1, 46-R1, and 48-R1 are equal to one another. For example, the first and fourth normal force F1⊥ and F4⊥ applied to the photosensitive drum 40 from the developing rollers 42-R1 and 48-R1 of the first and fourth color developing units 42 and 48 are equal to each other as shown by comparing the length of the arrow of the first normal force F1⊥ with that of the fourth normal force F4⊥. Similarly, the second and third normal forces F2⊥ and F3⊥ applied to the photosensitive drum 40 from the developing rollers 44-R1 and 46-R1 of the second and third developing units 44 and 46 are also equal to each other.

Likewise, since the normal force applied to the photosensitive drum 40 from the developing rollers 42-R1, 44-R1, 46-R1, and 48-R1 varies according to the positions of the developing rollers 42-R1, 44-R1, 46-R1, and 48-R1, preferably, the first through fourth normal force F1⊥, F2⊥, F3⊥, and F4⊥ applied to the photosensitive drum 40 have values in a predetermined range, i.e., of about 500 gf to about 1,500 gf during the development operation. In order to generate the normal forces having the same value in the radial direction, the forces should be different from each other in the direction parallel to the horizontal axis H.

For this reason, preferably, spring constants of the first through fourth tension springs S1, S2, S3, and S4 mounted in the first through fourth color developing units 42, 44, 46, and 48, that is, elasticity coefficients, are different. For example, since the first normal force F1⊥ is smaller than the second normal force F2⊥, preferably, the elasticity coefficient of the first tension spring S1 mounted in the first developing unit 42 is larger than that of the second tension spring S2 mounted in the second developing unit 44. In this case, preferably, the elasticity coefficients of the first through fourth tension springs S1, S2, S3, and S4 are of about 0.1 gf to about 0.5 gf.

The elasticity of the spring varies according to shapes of the springs as well as materials of the springs. For example, the elasticity coefficient of the spring varies according to a thickness of the spring. Thus, in a case that materials of the first through fourth tension springs S1, S2, S3, and S4 are the same, preferably, the thickness of the first through fourth tension springs S1, S2, S3, and S4 should be different from one another in consideration of the magnitudes of the first through fourth normal force F1⊥, F2⊥, F3⊥, and F4⊥. For example, since the third normal force F3⊥ is larger than the fourth normal force F4⊥, the third tension spring S3 should have a smaller thickness than the fourth tension spring S4.

Likewise, in a case that the materials of the first through fourth tension springs S1, S2, S3, and S4 are the same, the thicknesses of the first through fourth tension springs S1, S2, S3, and S4 are different so that the magnitudes of the normal forces F1⊥, F2⊥, F3⊥, and F4⊥ applied to the photosensitive drum 40 are the same.

In another case that the thicknesses of the first through fourth tension springs S1, S2, S3, and S4 are the same, preferably, the materials of the first through fourth tension springs S1, S2, S3, and S4 should be different in consideration of the magnitudes of the first through fourth normal forces F1⊥, F2⊥, F3⊥, and F4⊥, so that the first through fourth normal forces F1⊥, F2⊥, F3⊥, and F4⊥ applied to the photosensitive drum 40 are equal to one another. For example, since the first normal force F1⊥ is smaller than the second normal force F2⊥ due to the angle between the radial line and the horizontal axis H, preferably, the first tension spring S1 is formed of a material having larger acting force than that of the second tension spring S2 with respect to the same displacement so that the first normal force F1⊥ and the second normal force F2⊥ are the same.

Likewise, even when the materials of the first through fourth tension springs S1, S2, S3, and S4 are different, preferably, the elasticity coefficients of the first through fourth tension springs S1, S2, S3, and S4 are of about 0.1 to about 0.5, like in a case when the materials of the first through fourth tension springs S1, S2, S3, and S4 are the same and their thicknesses are different.

This invention has been particularly shown and described with reference to a few preferred embodiments thereof and must not be interpreted as limiting the scope of the present invention. In particular, it will be understood by those skilled in the art that leaf springs having the same elasticity coefficient may be used instead of the tension springs in the first or fourth color developing units to generate relatively small normal forces applied to the photosensitive drum. Otherwise, both the tension springs and the leaf springs having small elasticity coefficients may be used in the first through fourth developing units. the repulsive acting force of the tension springs of the first through fourth color developing units with respect to the same displacement is smaller than that of the leaf springs, but shock between the photosensitive drum and the developing roller can be absorbed, and the tension springs for applying the same pressure, that is, the same normal forces, to the photosensitive drum are mounted in respective developing units. Thus, the shock generating when the photosensitive drum contacts the developing roller can be slightly absorbed, and thus jitter or bending of the image can be removed or minimized in the development operation.

In addition, since the normal force applied to the photosensitive drum from the developing roller can be maintained in a small value range regardless of the positions of the developing rollers, the deterioration of the image quality due to a pressure difference can be prevented. Further, the shock between the photosensitive drum and the developing roller is reduced, and thus the developing roller can smoothly contact and be separated from the photosensitive drum, and the scattering of toner caused when the developing roller contacts and/or separates from the photosensitive drum can be minimized.

While this invention has been particularly shown and described with reference to a few preferred embodiments thereof, it will be understood by those skilled in the art that various changes in form and details may be made therein without departing from the spirit and scope of the invention as defined by the appended claims and equivalent thereof.

What is claimed is:

1. An apparatus for forming a color image using electrophotography, the apparatus comprising:

a photosensitive drum on which a predetermined electrostatic latent image is formed;

a plurality of developing units disposed around the photosensitive drum and each including a developing roller supplying toner to a corresponding surface of the photosensitive drum to develop the electrostatic latent image;

pressure cams sequentially or selectively pressing corresponding developing units against the photosensitive drum when the electrostatic latent image is developed; and a bracket slide including tension springs disposed to be coupled to corresponding developing units to generate the same normal force regardless of relative positions of the developing units with respect to the corresponding surface of the photosensitive drum, the same normal force being applied to the corresponding surface of the photosensitive drum from the developing roller of the corresponding developing units to reduce a shock generating when the developing roller contacts the corresponding surface of the photosensitive drum.

2. The apparatus of claim 1, wherein the tension springs of the developing units are made of the same material and have a thickness different from each other.

3. The apparatus of claim 1, wherein the tension springs have the same thickness and are made of a material different from each other.

4. The apparatus of claim 1, wherein the normal force applied to the photosensitive drum from the developing roller is between about 500 gf to about 1,500 gf inclusive.

5. An apparatus for forming a color image using electrophotography, the apparatus comprising:

a photosensitive drum having a predetermined electrostatic latent image;

a plurality of developing units disposed parallel to each other to move in a parallel direction and each including a developing roller developing the electrostatic latent image;

a plurality of cams disposed to push corresponding developing units toward the photosensitive drum in the parallel direction when the electrostatic latent image is developed;

a bracket slide disposed to guide the developing units in the parallel direction; and tension springs disposed on the bracket slide to generate respective parallel forces different from each other from the developing roller to the photosensitive drum in the parallel direction when the developing roller of the respective develop units contacts the photosensitive drum in the parallel direction to develop the latent electrostatic image.

6. The apparatus of claim 5, wherein the tension springs generate the different parallel forces having the same normal force in respective radial directions from a center of the developing roller of the respective developing units to a center of the photosensitive drum regardless of the respective positions.

7. The apparatus of claim 6, wherein the tension springs generate the different parallel forces in accordance with respective angles formed between a radial axis of the photosensitive drum and lines normal to radial directions of the photosensitive drum at respective points of contact between the photosensitive drum and the developing rollers.

8. The apparatus of claim 5, wherein the tension springs are disposed between the slide guide and corresponding ones of the developing units.

9. The apparatus of claim 5, wherein each cam generates a pushing force to push the developing roller of the corresponding developing units toward the photosensitive drum in the parallel direction, and the corresponding tension spring is extended to generate the same normal force in response to the pushing force.

10. The apparatus of claim 9, wherein the same normal force is generated in accordance with the pushing force and the corresponding parallel force.

11. The apparatus of claim 9, wherein the cams generate the same pushing force.

12. The apparatus of claim 9, wherein the tension springs are disposed between the cams and the corresponding developing units.

13. An apparatus for forming a color image using electrophotography, the apparatus comprising:

a photosensitive drum having a predetermined electrostatic latent image;

first, second, third, and fourth developing units disposed parallel to one another in a parallel direction;

first, second, third, and fourth developing rollers disposed in respective first, second, third, and fourth developing units to develop the electrostatic latent; and first, second, third, and fourth elastic members disposed to be connected to corresponding ones of the first, second, third, and fourth developing units to generate the same normal force in respective radial directions from respective centers of the developing rollers to a corresponding surface of the photosensitive drum when the developing units move toward the photosensitive drum in the parallel direction.

14. The apparatus of claim 13, wherein the first and second developing units are disposed opposite to the third and fourth developing units with respect to a parallel line disposed between the second and third developing units to pass the center of the photosensitive drum, and the first and fourth elastic members generate the same first parallel force parallel to the parallel direction while the second and third elastic members generates the same second parallel force parallel to the parallel direction and different from the first parallel force.

15. The apparatus of claim 14, wherein the first and fourth elastic members have the same first thickness while the second and third elastic members have the same second thickness different from the first thickness.

16. The apparatus of claim 15, wherein first, second, third, and fourth elastic members are one of a leaf spring and a tension spring.

17. The apparatus of claim 14, wherein the first and fourth elastic members have the same first elastic force while the second and third elastic members have the same second elastic force different from the first elastic force.

18. The apparatus of claim 14, wherein the first and fourth elastic members have the same first elastic coefficient while the second and third elastic members have the same second elastic coefficient different from the first elastic coefficient.

19. The apparatus of claim 14, wherein the first and fourth elastic members have the same first length while the second and third elastic members have the same second length different from the first length.

20. The apparatus of claim 14, wherein the first and fourth elastic members are made of the same first material while the second and third elastic members are made of the same second material different from the first material.

21. The apparatus of claim 14, wherein the first elastic member has an elastic force greater than that of the second elastic member in the parallel direction.

22. The apparatus of claim 14, wherein the apparatus comprises first, second, third, fourth cams generating first, second, third, and fourth cam forces pushing respective ones of the first, second, third, and fourth developing units toward the photosensitive drum, and the first, second, third, and fourth elastic members generate the same normal force in response to both respective elasticity coefficients and respective ones of the first, second, third, and fourth cam forces.

23. The apparatus of claim 22, wherein the first, second, third, and fourth cam forces are the same.

24. The apparatus of claim 22, wherein the first, second, third, and fourth cam forces are different from one another.

25. The apparatus of claim 13, wherein first, second, third, and fourth elastic members generate a parallel force different from one another.

* * * * *